US008083863B2

(12) United States Patent
Oppel et al.

(10) Patent No.: US 8,083,863 B2
(45) Date of Patent: Dec. 27, 2011

(54) DISHWASHER WITH A DOOR SEAL

(75) Inventors: Anton Oppel, Syrgenstein (DE); Erich Schmid, Sontheim a.d.Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1063 days.

(21) Appl. No.: 10/583,694

(22) PCT Filed: Dec. 22, 2004

(86) PCT No.: PCT/EP2004/053658

§ 371 (c)(1),
(2), (4) Date: Jun. 20, 2006

(87) PCT Pub. No.: WO2005/060818

PCT Pub. Date: Jul. 7, 2005

(65) Prior Publication Data

US 2007/0181168 A1 Aug. 9, 2007

(30) Foreign Application Priority Data

Dec. 22, 2003 (DE) ..... 103 60 558
Dec. 17, 2004 (DE) ..... 10 2004 060 953

(51) Int. Cl.
*B08B 3/00* (2006.01)

(52) U.S. Cl. ..... 134/56 D; 134/57 D; 134/58 D; 134/114

(58) Field of Classification Search ..... 134/56 D, 134/56 R, 57 D, 57 DL, 57 R, 58 D, 58 DL, 134/58 R, 114
See application file for complete search history.

(56) References Cited

U.S. PATENT DOCUMENTS 2,554,452 A 5/1951 Bright
3,837,120 A * 9/1974 Hanks et al. ..... 49/489.1
4,916,864 A * 4/1990 Thompson ..... 49/478.1
5,115,826 A * 5/1992 Bertsch et al. ..... 134/183
(Continued)

FOREIGN PATENT DOCUMENTS

DE 1 182 784 12/1964
(Continued)

OTHER PUBLICATIONS

International Search Report PCT/EP2004/053658.

*Primary Examiner* — Michael Barr
*Assistant Examiner* — Benjamin Osterhout
(74) *Attorney, Agent, or Firm* — James E. Howard; Andre Pallapies

(57) ABSTRACT

A seal is provided between the door apron and the lip of the container in a dishwasher, enabling a high sealing performance to be obtained during the entire service life of the dishwasher and providing an esthetic design. The seal can be mounted in a reliable manner without any considerable expenditure of force, recycling of a used seal is possible via appropriate selection of materials and the seal can withstand the dynamic strain put upon the door seal of a dishwasher. The dishwasher is provided with a door seal which is made of an elastic synthetic material, consisting of a fixing area for connection to the edge of a rinsing container, a sealing element for arrangement on the underside of a dishwasher and which is arranged between the fixing area, and a sealing element, wherein the fixing area, sealing element and sealing strip form a single part.

20 Claims, 5 Drawing Sheets

U.S. PATENT DOCUMENTS

| | | | | |
|---|---|---|---|---|
| 5,566,954 | A * | 10/1996 | Hahn | 277/642 |
| 2002/0117194 | A1* | 8/2002 | Hechtl et al. | 134/114 |
| 2003/0041523 | A1 | 3/2003 | Kiesler et al. | |
| 2003/0230955 | A1* | 12/2003 | Welch | 312/228 |
| 2005/0076938 | A1* | 4/2005 | Jordan et al. | 134/183 |
| 2005/0257816 | A1* | 11/2005 | Kim | 134/200 |

FOREIGN PATENT DOCUMENTS

| | | | |
|---|---|---|---|
| DE | 39 19 773 | | 12/1990 |
| DE | 295 09 093 | | 9/1995 |
| EP | 1 281 345 | * | 2/2003 |
| FR | 2 788 841 | * | 1/1999 |
| FR | 2 788 841 | | 7/2000 |

* cited by examiner

DISHWASHER WITH A DOOR SEAL

The present invention relates to a dishwasher with a door seal.

When closed, a conventional dishwasher has a substantially rectangular washing container, one side of which can be opened and closed by means of a pivotable door. The four peripheral side areas must, when the dishwasher is closed, exhibit during the entire lifetime of the dishwasher a uniform sealing performance both with regard to spray water and also with regard to a certain excess pressure.

Whereas the two vertical side areas and the horizontal upper side can be sealed by means of so-called sealing beading, which is disposed in corresponding joints in the washing container or the housing, the sealing of the underside located in the proximity of the horizontally disposed pivot axis conceals numerous problems, for example, as a result of the substantially 90-degree pivot angle, a relative movement takes place between the underside of the door (door apron) and the upper edge of the washing container (container lip). Furthermore, it is desirable to make assembly easy but dismantling should be more difficult. It is also desirable to take into account the aesthetic demands of the user, especially in high-quality consumer goods.

It is thus the object of the present invention to provide a dishwasher with a seal between the door apron and the container lip, enabling a high sealing performance to be obtained during the entire service life of the dishwasher and providing an aesthetic appearance while the seal can be mounted reliably without any considerable expenditure of force, recycling is possible as a result of the choice of material and said seal can withstand the dynamic strains of a door seal for a dishwasher.

This object is achieved by the dishwasher according to the invention having a door seal with the features according to the independent claims.

Advantageous further developments of the invention are characterised in the dependent claims.

The dishwasher with a door seal according to the invention comprises a door seal provided with a fixing area, a sealing element and a sealing strip, wherein the sealing area is connected to the sealing element via the sealing strip.

The door seal in the dishwasher is preferably made of an elastic plastic, especially thermoplastics and the fixing area is suitable for connection to the edge of the washing container and has a sealing function with respect to the washing container, and the sealing element is suitable for being arranged on an underside of the dishwasher door.

The fixing area, the sealing element and the sealing strip are preferably constructed in one piece. The door seal is thus particularly simple and cost-effective to produce and can produce a reliable seal.

The fixing area is preferably used to achieve the sealing effect on the edge of the washing container. Thus, no additional formations are required to achieve this sealing effect.

In a further embodiment, the fixing area is formed from a hook-shaped or U-shaped section on the inside of which protruding resilient retaining elements are arranged.

In additional variant, the sealing element is formed from a frame-shaped hollow profile and is suitable for being fixed by means of fixing means in the area of the underside of the dishwasher.

The sealing strip is preferably constructed free of any reinforcing means made of different material.

In a preferred embodiment at least one sealing lip is disposed on the frame-shaped hollow profile to seal between the sealing element and the dishwasher door.

Advantageously, recesses with corresponding ribs are arranged in the frame-shaped hollow profile of the sealing element on the outside to increase the rigidity of the sealing element in the longitudinal direction.

In a further embodiment reinforcing ribs are arranged in the frame-shaped hollow profile on the inside.

The door seal of the dishwasher according to the invention preferably consists of a thermoplastic material such as, for example, polypropylene and polyethylene and is produced by means of plastic injection moulding or extrusion. The manufacturing method can be made more efficient by the one-piece manufacture of the door seal according to the invention and thus contributes towards cost savings. The ribs integrated in the sealing strip during manufacture enable a predetermined rolling-up and unrolling of the sealing strip to be achieved when actuating, i.e., pivoting open the appliance door so that no kinks or bulges are formed which could have a negative influence on the good sealing performance. The sealing strip thus functions as a film hinge.

When mounting the door seal of the dishwasher according to the invention, the fixing area is slid over the container lip. As a result of the pre-formed resilient retaining elements, this sliding movement can be achieved manually without any tools. However, as a result of the alignment of the resilient retaining elements, this fixing area can only be released with far greater forces since during a releasing movement, i.e. an attempted withdrawal of the fixing area from the container lip, the resilient retaining elements are compressed and apply a correspondingly high pressure to the contact area between the retaining element and container lip.

The fixing area can only be completely released from the container lip after overcoming a certain resistance. It has proved to be particularly advantageous in this case that no lubricants are required for mounting and dismantling since as a result of the material pairing (surface structure pairing) of the container lip and the retaining elements, mounting can easily be accomplished whereas dismounting requires an increased expenditure of force.

After mounting the fixing area on the container lip, the sealing strip provided with ribs extends in the direction of the washing container and at its other end has the frame-shaped hollow profile which is fixed by means of suitable fixing means for the underside of the door. For example, this type of fixing was effected by means of laterally protruding fixing lugs on the inside of the door.

In a preferred embodiment of the door seal of the dishwasher according to the invention, a sealing lip spreads from the frame-shaped hollow profile and forms an apron-like cover between the frame-shaped hollow profile and the sealing strip. This apron-like cover can form an improved protection device towards the sealing strip, for example, in the event of falling knives or other items of cutlery. When the dishwasher door is closed, the sealing lip abuts against the dishwasher door over its entire length and thus forms the first sealing line with respect to the circulating washing solution in the washing container and the dishwasher door. Located after the sealing lip is the sealing strip which provides a further sealing function.

Both the sealing lip mounted at the front and the sealing strip thus form a very effective sealing arrangement which prevents the circulating quantities of washing water from being able to flow behind the inside of the door or over the container lip.

The present invention is explained in detail using a preferred embodiment with reference to the following drawings.

Figure 1:
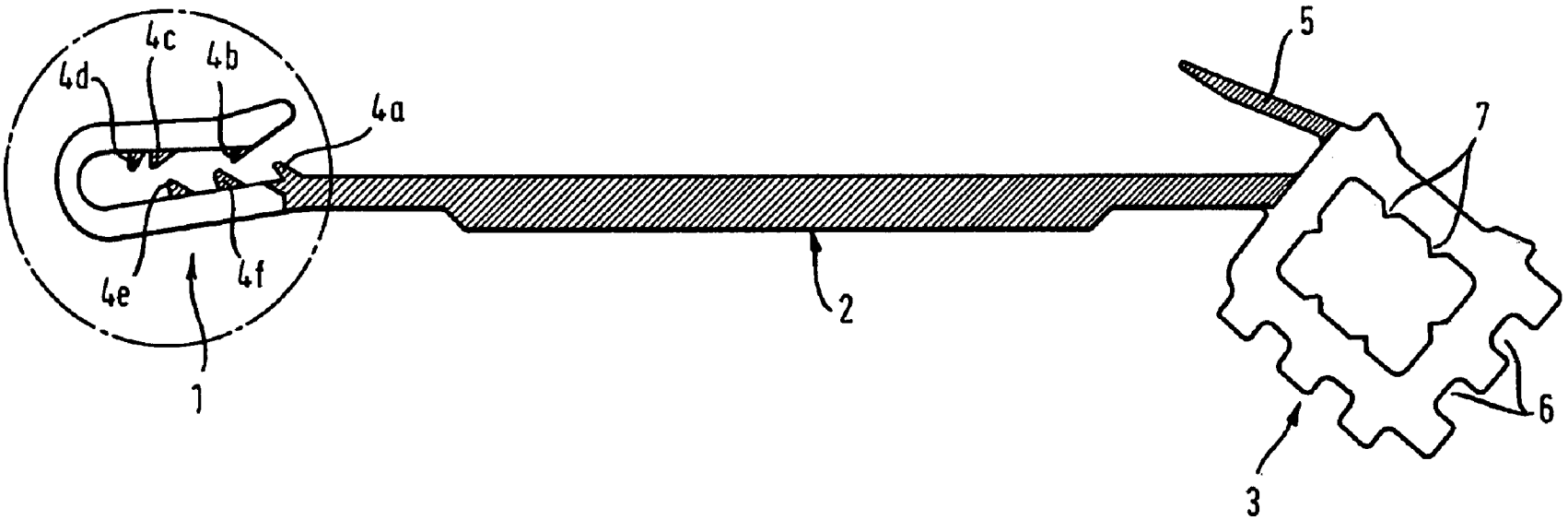
FIG. 1 shows a cross-section through the door seal of the dishwasher according to the invention.

The left side of FIG. 1 shows the fixing area 1 of the door seal of the dishwasher according to the invention which has a plurality of retaining elements (here 4*a*-4*f*) in its interior which, as a result of their alignment, i.e., slightly inclined towards the inside of the fixing area 1, facilitate mounting on the one hand and on the other hand make dismounting difficult to carry out so that the door seal according to the invention cannot be removed in an uncontrolled manner (the dishwasher according to the invention is not shown).

The non-hatched area of the fixing area 1 is preferably made of polypropylene and is especially preferably also thermally stabilised while the hatched area is also made of polypropylene but has not been thermally stabilised so that the elasticity is greater, this being more favourable for the sealing effect. The sealing function of the door seal according to the invention is substantially taken over by the areas shown hatched in FIGS. 1 and 2, i.e., the retaining elements 4*a* to 4*f*, the sealing strip 2 and the sealing lip 5.

Figure 4:
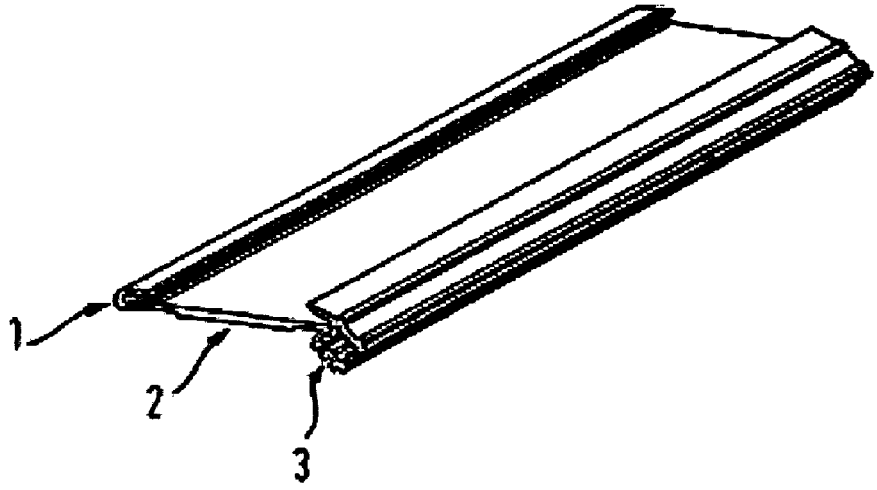
FIG. 4 is a perspective view of the door seal according to the invention.

The sealing strip 2 shown hatched also functions as a film hinge to allow reliable bending without buckling and bulging. When the door is closed, the sealing strip 2 is normally bent through about 180°, i.e. is arranged in a U-shape. As shown in FIGS. 1 and 4, the sealing strip 2 is composed of two strips which are joined together by means of ribs. Cavities are thus formed between the two strips and the ribs. In a further preferred embodiment (not shown) the sealing strip 2 is formed without cavities but with recesses perpendicular to the plane of the drawing according to FIG. 1. These recesses (in longitudinal section in a view according to FIG. 1 which is not shown, areas of smaller thickness) act as additional hinges as a result of their smaller thickness so that the sealing strip 2 can be bent more easily.

The sealing element 3 has recesses 6 on the outside with corresponding ribs. This structure is used to reinforce the sealing element 3. Reinforcing ribs 7 on the inside of the sealing element 3 are additionally used for reinforcement. The sealing element 3, for example, is only fixed at both ends on the lower side of the (inner) door of the dishwasher using pins which engage in the cavity of the sealing element 3. So that the sealing element 3 does not bend over the width of the inner door, the sealing element 3 must have sufficient rigidity in the longitudinal direction. The sealing strip 2 forms the connection between the fixing area 1 on the washing container and the sealing element 3 on the inner door of the dishwasher. The sealing lip 5 is pressed against the inner door, thus producing a sealing effect at the dishwasher door.

Figure 2:
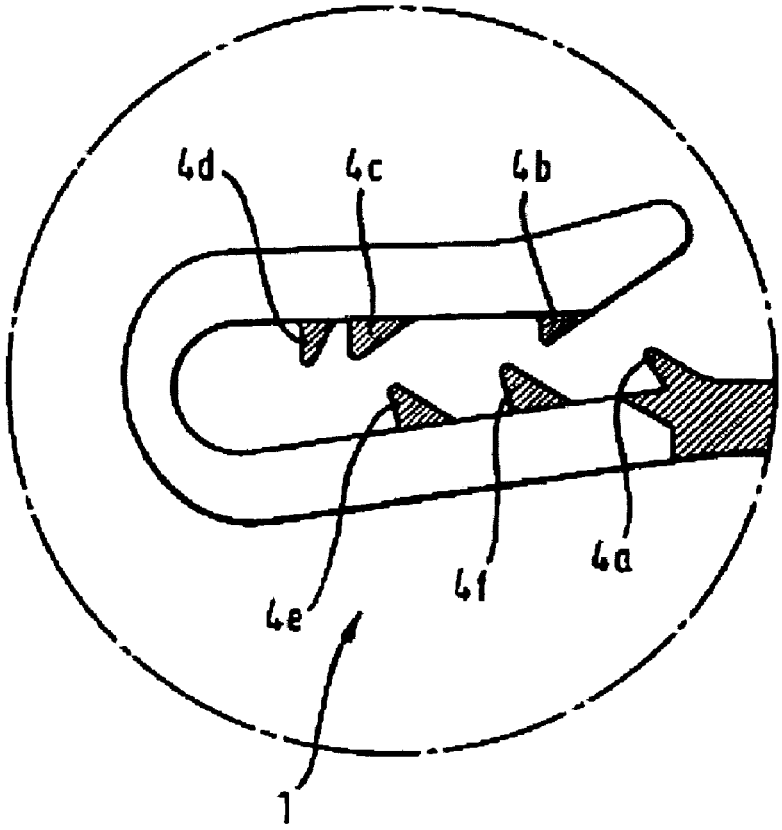
FIG. 2 is an enlarged view of the fixing area 1 according to FIG. 1.

FIG. 2 shows a detailed view of the fixing area 1 with the elastic retaining elements 4*a* to 4*f*. The choice of material for the non-hatched area is advantageously a thermally stabilised polypropylene, the hatched area is appropriately made of a non-thermally stabilised polypropylene which has higher elastic properties compared with the other region in order to additionally increase the sealing function.

Figure 3:
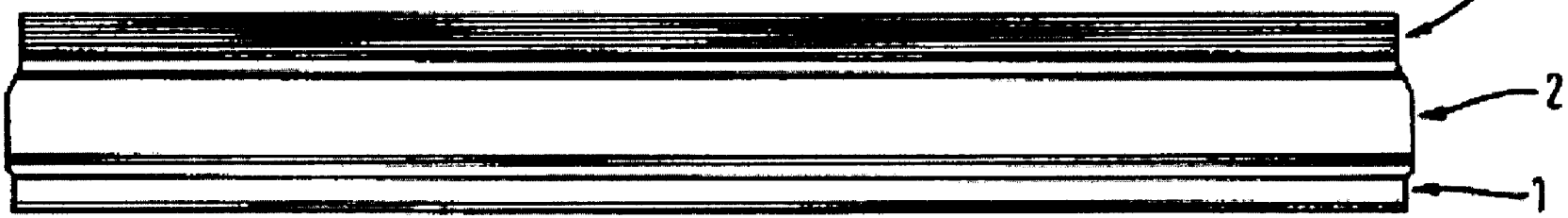
FIG. 3 is a plan view of the door seal according to the invention.

FIG. 3 shows a plan view of the door seal of the dishwasher according to the invention with the areas, fixing area 1, sealing strip 2 and sealing area 3. FIG. 4 shows a perspective view of the door seal according to the invention.

Figure 5:
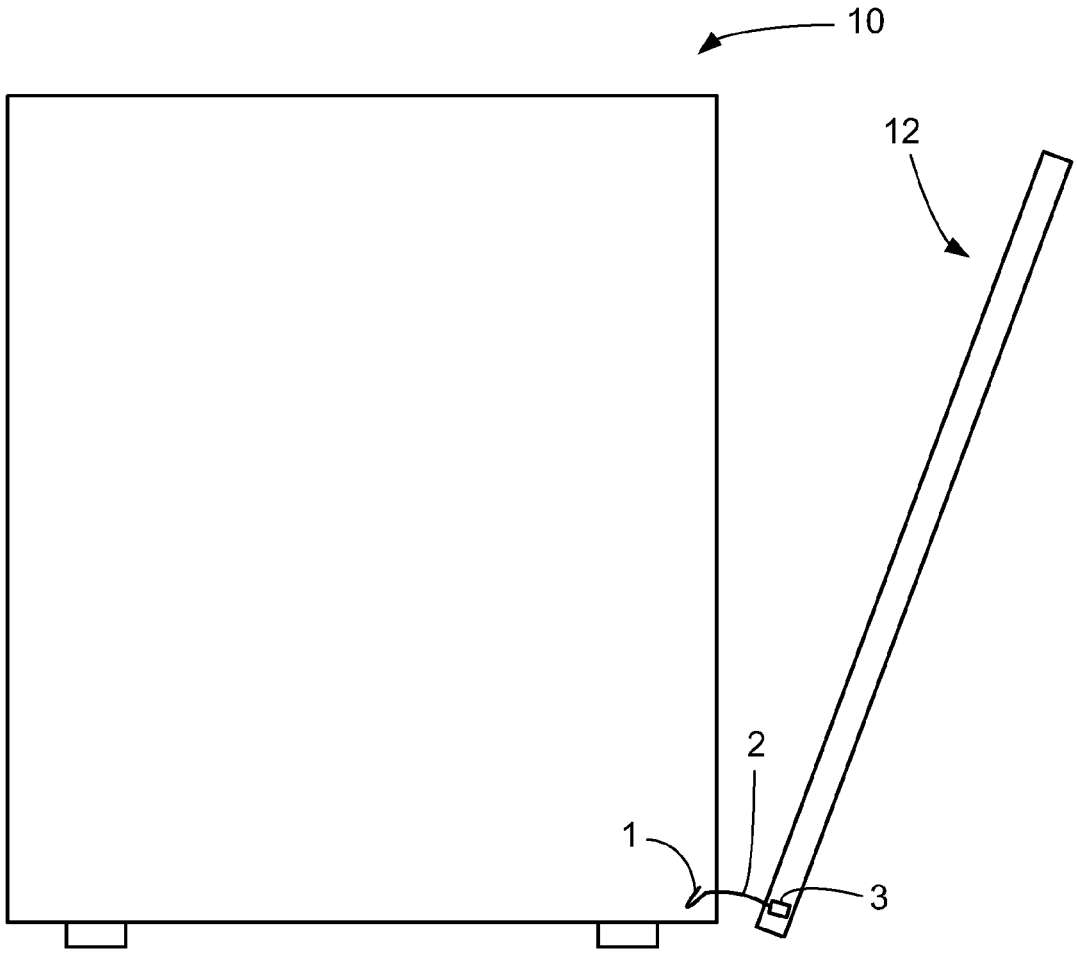
FIG. 5 is a schematic view of a dishwasher and door seal according to the invention.

FIG. 5 shows a schematic view of a dishwasher 10 having a door 12 and shows the door seal connecting the door 12 to the dishwasher 10.

REFERENCE LIST

1 Fixing area
2 Sealing strip
3 Sealing element
4*a-f* Retaining element
5 Sealing lip
6 Recess
7 Reinforcing rib

The invention claimed is:

1. A dishwasher comprising:

a door;

a container for retaining therein items to be washed, the container having an open side that is selectibly closable via pivoting of the door between a closed disposition and an open disposition; and a door seal having a fixing area, a sealing element, an elastic sealing strip, and an elastic sealing lip, the fixing area being connected to the sealing element by the sealing strip, wherein the sealing strip is more elastic than the fixing area and the sealing element, and the sealing lip is more elastic than the fixing area and the sealing element, is attached to the sealing element, and presses against the door to create a seal with the door.

2. The dishwasher according to claim 1, wherein the door seal is made of an elastic material, the fixing area is connected to an edge of the washing container and has a sealing function with respect to the washing container, and the sealing element is mounted on an underside of the dishwasher door.

3. The dishwasher according to claim 2, wherein a cross section of the sealing strip has a first portion adjacent to where the sealing strip connects to the fixing area, a second portion adjacent to where the sealing strip connects to the sealing element, and a third portion that connects the first portion to the second portion, the first portion has a first thickness, the second portion has a second thickness, and the third portion has a third thickness, and the third thickness is greater than the first thickness and is greater than the second thickness.

4. The dishwasher according to claim 1, wherein the fixing area, the sealing element and the sealing strip are constructed in one piece.

5. The dishwasher according to claim 1, wherein the fixing area contributes to the sealing effect on an edge of the washing container.

6. The dishwasher according to claim 1, wherein the fixing area is a U-shaped section.

7. The dishwasher according to claim 1, wherein the sealing strip is constructed free of any reinforcing means made of different material.

8. The dishwasher according to claim 1, wherein a cross section of the sealing strip has a first portion adjacent to where the sealing strip connects to the fixing area, a second portion adjacent to where the sealing strip connects to the sealing element, and a third portion that connects the first portion to the second portion, the first portion has a first thickness, the second portion has a second thickness, and the third portion has a third thickness, and the third thickness is greater than the first thickness and is greater than the second thickness.

9. A dishwasher, comprising:

a door having an inner surface;

a container for retaining therein items to be washed, the container having an open side that is selectibly closable via pivoting of the door between a closed position and an open position; and a door seal having a fixing area, a sealing element having a hollow tubular main body, an elastic sealing strip, the sealing strip connecting the fixing area to the sealing element, and an elastic sealing lip connected to and extending from the sealing element, wherein the fixing area is fixed to the container to create a seal with the container, the fixing area being stationary relative to the container when the door is pivoted between the closed position and the open position, the sealing element is attached to the door, and the sealing lip is pressed against the inner surface of the door to create a seal with the door.

10. The dishwasher according to claim 9, wherein the door seal is made of an elastic material, the fixing area is adapted for connection to an edge of the washing container and has a sealing function with respect to the washing container, and the sealing element is adapted for mounting on an underside of the dishwasher door.

11. The dishwasher according to claim 9, wherein the fixing area, the sealing element and the sealing strip are constructed in one piece.

12. The dishwasher according to claim 9, wherein the fixing area contributes to the sealing effect on an edge of the washing container.

13. The dishwasher according to claim 9, wherein the fixing area is a U-shaped section.

14. The dishwasher according to claim 13, further comprising retaining elements protruding from the inside of the U-shaped section of the fixing area.

15. The dishwasher according to claim 9, wherein the sealing strip is constructed free of any reinforcing means made of different material.

16. The dishwasher according to claim 9, further comprising reinforcing ribs arranged on the inside of the hollow tubular main body of the sealing element.

17. The dishwasher according to claim 9, wherein the hollow tubular main body of the sealing element is rectilinear in cross section.

18. The dishwasher according to claim 17, further comprising recesses with corresponding ribs arranged on the outside of the hollow tubular main body of the sealing element to increase the rigidity of the sealing element in its longitudinal direction.

19. The dishwasher according to claim 9, wherein a cross section of the sealing strip has a first portion adjacent to where the sealing strip connects to the fixing area, a second portion adjacent to where the sealing strip connects to the sealing element, and a third portion that connects the first portion to the second portion, the first portion has a first thickness, the second portion has a second thickness, and the third portion has a third thickness, and the third thickness is greater than the first thickness and is greater than the second thickness.

20. The dishwasher according to claim 9, wherein ends of the hollow tubular main body of the sealing element are adapted to receive pins protruding from the door.

* * * * *